US006860339B2

(12) United States Patent
Lim

(10) Patent No.: US 6,860,339 B2
(45) Date of Patent: Mar. 1, 2005

(54) BIT STRIKING APPARATUS FOR USE IN AN EXCAVATOR

(76) Inventor: Byung Duk Lim, 337 (20/4) Seoho Apt 105-1104, Deokjin-gu, Songcheon-dong 1ga, Jeollabuk-do (KR)

( * ) Notice: Subject to any disclaimer, the term of this patent is extended or adjusted under 35 U.S.C. 154(b) by 0 days.

(21) Appl. No.: 10/441,871

(22) Filed: May 20, 2003

(65) Prior Publication Data

US 2004/0016154 A1 Jan. 29, 2004

(30) Foreign Application Priority Data

Jul. 10, 2002 (KR) ..... 20-2002-0020654

(51) Int. Cl.[7] ..... E21B 4/14
(52) U.S. Cl. ..... 173/91; 175/19
(58) Field of Search ..... 173/90, 91, 206, 173/136, 137; 175/56, 19, 57

(56) References Cited

U.S. PATENT DOCUMENTS 4,953,626 A * 9/1990 Puttmann et al. ..... 173/91
5,488,998 A * 2/1996 Ekwall et al. ..... 173/91
5,915,483 A * 6/1999 Gien ..... 173/91
5,944,117 A * 8/1999 Burkholder et al. ..... 173/91
6,131,672 A * 10/2000 Beccu et al. ..... 173/91
6,209,666 B1 * 4/2001 Beccu et al. ..... 175/296
6,499,544 B1 * 12/2002 Shofner ..... 173/91
6,637,520 B1 * 10/2003 Purcell ..... 173/91

FOREIGN PATENT DOCUMENTS

| | | |
|---|---|---|
| KR | 20-0123970 U | 6/1998 |
| KR | 20-0123971 U | 6/1998 |
| KR | 10-0270035 U | 7/2001 |
| KR | 10-0303201 U | 7/2001 |
| KR | 10-0309297 U | 9/2001 |
| KR | 20-0274273 U | 4/2002 |
| KR | 20-0388088 U | 8/2002 |

* cited by examiner

*Primary Examiner*—Scott A. Smith
(74) *Attorney, Agent, or Firm*—Cheryl H. Agris

(57) ABSTRACT

Disclosed is a bit striking apparatus in an excavator capable of efficiently striking the entire area of the hammer bit under uniform pressure without exerting excessive load to the excavator so that the hammer bit may be free from damage owing to local concentration of striking force of the piston.

4 Claims, 5 Drawing Sheets

BIT STRIKING APPARATUS FOR USE IN AN EXCAVATOR

PRIORITY CLAIM

This application claims priority to Korean Patent Application no. 2002-20654, filed Jul. 10, 2002, the contents of which are incorporated herein by reference.

FIELD OF THE INVENTION

The present invention relates to a bit striking apparatus for use in an excavator. In particular, the bit striking apparatus can efficiently strike the entire area of a hammer bit under uniform pressure without exerting an excessive load to the excavator so that the hammer bit may be free from damage owing to local concentration of striking force of a piston.

BACKGROUND OF THE INVENTION

In general "boring" refers to an operation of drilling a small diameter of bore into the ground to obtain information about structures and qualities of strata. Boring is performed to obtain information inside the ground or extract petroleum, natural gas, hot spring, subterranean water and so on.

Excavations or bores are made in various magnitudes with lengths of about several to several thousand meters and diameters from several millimeters to tens of centimeters. At present, a bore or excavation is excavated by a large scale up to a diameter of several meters in order to use the bore or excavation as a vertical shaft.

Boring methods are divided into an impact-type boring in which impact is applied to a bit to crush rocks forming a bore and a rotary boring in which a bit attached to a steel pipe together with diamond and/or hard metal is rotated while being pressed against a rock forming a bore. The deepest bore or excavation in the world reaches about 8,000 m which is bored in a petroleum field in the United States.

In such a deep bore, a number of steel pipes having a predetermined length are connected in order to extend their entire length. However, the steel pipes or rods (hereinafter will be referred to as "steel pipe") are frequently raised in order to exchange bits, insert a steel pipe (also referred to as "casing pipe") into the bore, or perform various examinations.

A large winding machine tower is installed to this end, and power equipments are arranged around the winding machine tower together with other facilities for excavated mud, which are used to remove excavated material and thus to prevent collapse of cavity walls. Winding machine towers seen in the petroleum field indicate that boring is being performed.

Boring is also an important operation in mines for excavating subsurface ore deposits. Bores or shafts are used in the mines as drains or vents, passages for ores or waste rock, or passages for electric cables. A preliminary boring is generally performed before excavating a shaft in geological survey or exploration of ore deposits.

Although boring for mines is not performed by large scales as in well-drilling for petroleum, many techniques have been developed so that bores can be drilled in any direction or angle or to any depth. The rotary boring can extract rock core in the form of a stem to obtain the property and grade of rock and quality of ore deposit as desirable results for exploration. In the impact-type boring, rock powder extracted from a bore during excavation can be examined to judge the property and grade of rock. Such a boring for extracting "rock core" is referred to as core boring, and the boring for extracting rock powder is referred to as sludge boring.

Boring allows various measuring instruments and experimental apparatuses to be inserted into a bore so that this bore can be used as a hole for investigation of a structure or situation inside the crust. In addition, boring can be performed for preliminary investigation in dam construction or building.

An excavator in use for such boring utilizes various hammer bits of different standards and structures according to its use and stratum (geological) conditions. Types of the hammer bits are generally divided into a direct excavation-type hammer bit and an indirect excavation-type hammer bit.

The direct excavation-type hammer bit is used when stratum has a desirable condition or where boring is not shallowly performed, in which a bit housing mounted on a hammer drill is rotated to excavate the ground without using steel pipes.

The indirect excavation-type hammer bit is used where excavation is performed while steel pipes are buried in a bore, in which a bit housing and a bit mounted on a hammer drill are driven to excavate a bore wider than the diameter of steel pipes and then is pulled out through the steel pipes.

In the indirect excavation, as the hammer drill advances to a deeper subsurface position, pressure increases by large quantities so that load of great energy obstructs the hammer bit thereby causing difficulties to excavating operation.

Although hammer bits are variously priced according to the type and standard of an article, an indirect excavation-type hammer bit is high priced ranging from about 5,000 to 30,000 dollars per piece. So, excavation operation is performed vary carefully whenever a bore is drilled with the hammer bit. If the hammer bit is damaged or fractured in operation, this causes a problem that is directly related to construction cost.

However, excavating methods in conventional excavators have problems in that the entire area of a hammer bit in an excavator is not struck under uniform pressure so that striking force of an excavator piston may be partially focused in operation to instantaneously damage the hammer bit.

SUMMARY OF THE INVENTION

The present invention has been made in view of the foregoing problems and it is therefore an object of the present invention to provide a bit striking apparatus in an excavator capable of efficiently striking the entire area of the hammer bit under uniform pressure without exerting an excessive load to the excavator so that the hammer bit may be free from damage owing to local concentration of striking force of the piston.

According to an aspect of the invention to obtain the above objects, there is provided a bit striking apparatus in an excavator comprising: a back head having a central inlet through which air is introduced under a predetermined value of pressure; a check valve located under the inlet of the back head for preventing backflow of introduced air to the inlet of the back head; a sleeve tube for being hermetically coupled by an upper inner periphery with a lower end of the back head and slidably coupled by a lower inner periphery with a hammer bit which is fixed by a chuck; a piston located over the hammer bit within the sleeve tube for being moved up and down within the sleeve tube owing to distribution of air pressure by an air distributor to strike down the hammer bit; and the air distributor located between the back head and the piston within the sleeve tube for adequately distributing air so that the piston can be vertically moved to strike the hammer bit. In the bit striking apparatus of the invention, the air distributor includes: a cylindrical valve recess formed at an upper end for receiving the check valve, a through hole laterally formed under the valve recess, a fixing wing projected toward and tightly fixed to an inner periphery of the sleeve tube under the through holes and having a central through hole, an axial pipe fixed to a lower portion of the fixing wing and having an axial hole and elevation holes laterally formed in a lower portion of the axial pipe, and an operation pipe located under the fixing wing outside the axial pipe, in which the operation pipe has a central introduction hole, descent holes laterally formed in an upper portion of the operation pipe, elevation holes extended from the elevation holes of the axial pipe, and a communication pipe having through holes and coupled respectively with the elevation holes. Also, the piston includes: a central longitudinal channel for receiving the axial pipe and the operation pipe of the air distributor, an elevation hole formed in a position of the piston which is extended from the through holes in the communication tube in elevation of the piston within the sleeve tub after striking the hammer bit, a return recess formed in a position in the longitudinal channel which is extended from the through holes in the communication tube below the piston, the longitudinal channel being by its inner periphery in close contact with an outer periphery of the axial pipe under the return recess, the piston having an outer periphery corresponding to the inner periphery of the sleeve tube and a lower portion reduced in diameter, an exhaust introduction channel longitudinally formed in the outer periphery of the piston communicating with the elevation hole, and a threshold formed in a central portion of the introduction channel to tightly contact the inner periphery of the sleeve tube. Also, the sleeve tube includes an elevation recess formed on the inner periphery, in which the threshold in the piston is placed in impact of the hammer bit by the piston to open the exhaust introduction channel.

BRIEF DESCRIPTION OF THE DRAWINGS

The above and other objects, features and advantages of the present invention will be apparent from the following detailed description of the preferred embodiments of the invention in conjunction with the accompanying drawings, in which.

DETAILED DESCRIPTION OF THE INVENTION

Figure 1:
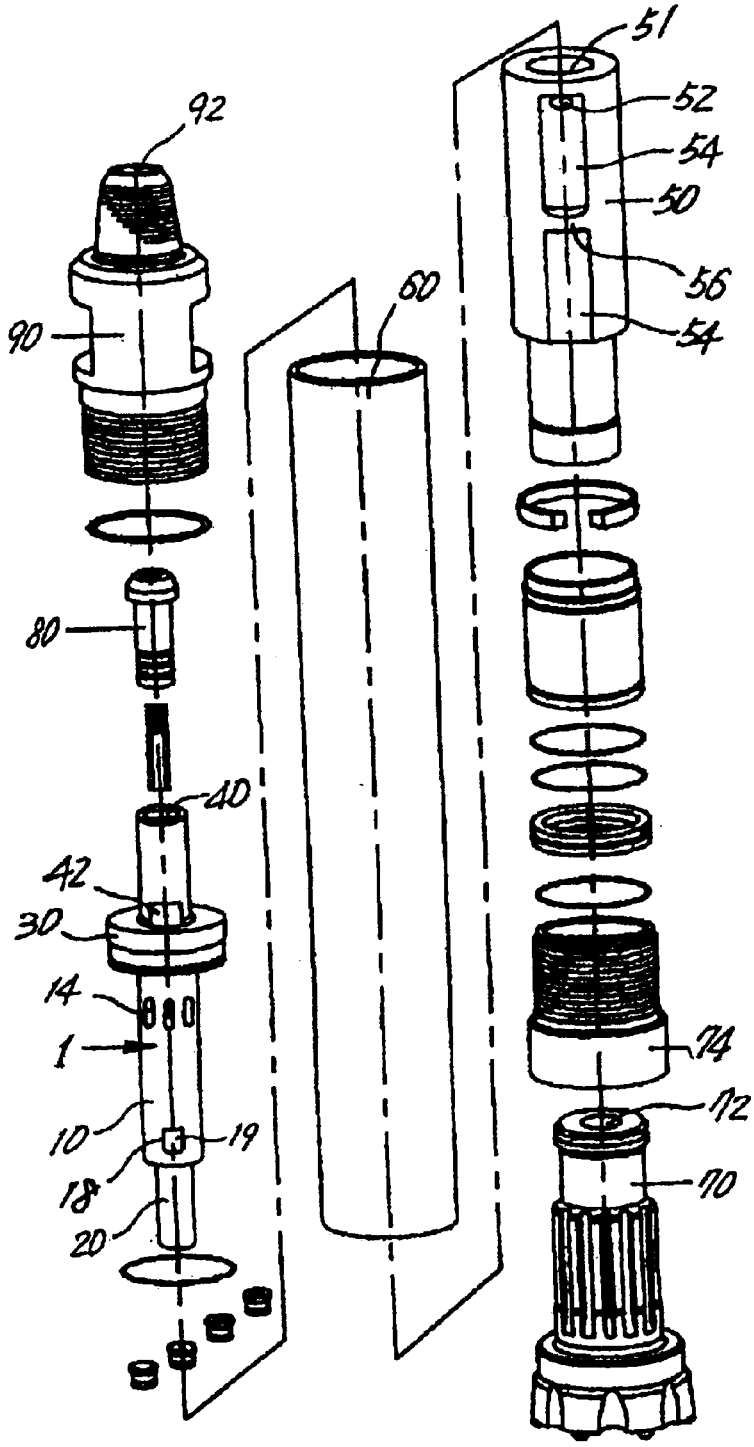
FIG. 1 is a detailed perspective view of a bit striking apparatus according to an embodiment of the invention.

Reference will now be made in detail to the preferred embodiments of the present invention, examples of which are illustrated in the accompanying drawings.

The bit striking apparatus in a drilling machine includes a back head 90 with an inlet 92 formed in its central portion, a check valve 80 located under the inlet 92 of the back head 90 for preventing backflow of introduced air to the inlet 92 of the back head 90, a sleeve tube 60 for being hermetically coupled by an upper inner periphery with a lower end of the back head 90 and slidably coupled by a lower inner periphery with a hammer bit 70 which is fixed by a chuck 74 and a piston 50 located over the hammer bit 70 within the sleeve tube 60 for being moved up and down within the sleeve tube 60 owing to distribution of air pressure by an air distributor 1 to strike down the hammer bit 70. The air distributor 1 is located between the back head 90 and the piston 50 within the sleeve tube 60 to adequately distribute air pressure so that the piston 50 can be vertically moved to strike the hammer bit 70.

The air distributor 1 is made of metal and placed within the sleeve tube 60 to adequately introduce air pressure so that the piston 50 can be vertically moved to strike the hammer bit 70. A valve recess 40 is provided at an upper end of the air distributor 1 in the shape of a cylinder for receiving the check valve 80, and a through hole 42 is laterally formed under the valve recess 40.

A fixing wing 30 is formed under the through hole 42, which is projected to the inner periphery of the sleeve tube 60 and tightly fixed thereto. A through hole 32 is formed in a central portion of the fixing wing 30 in a longitudinal direction of the wing 30. An axis hole 22 is formed under the through hole 32, and an axial pipe 20 is fixed to a lower portion of the wing 30. The axial pipe 20 has a blind lower end and elevation holes 16 laterally formed in a lower portion thereof. An introduction hole 12 is formed in a central lower end of the fixing wing 30 outside the axial pipe 20, and descent holes 14 are oppositely formed above the introduction hole 12. The elevation holes 16 are formed in an operation pipe 10, and extended from elevation holes 24 of the axial pipe 20. A communication tube 18 having through holes 19 is coupled with the elevation holes 16 and 24 so that air pressure filled in the axial hole 22 of the axial pipe 20 is exhausted out of the operation pipe 10 via the through holes 19 of the communication tube 18.

The piston 50 is made of metal, and vertically moved within the sleeve tube 60 through distribution of air pressure by the air distributor 1 to strike down the hammer bit 70. The piston 50 has a central longitudinal channel 51, into which the axial pipe 20 and the operation pipe 10 of the air distributor 1 are inserted, and an elevation hole 52 formed in a position, which is extended from the communication tube 18 having the through holes 19 coupled with the elevation holes 24 and 16 of the axial and operation pipes 20 and 10 when the piston 50 is elevated after striking the hammer bit 70 within the sleeve tube 60.

A return recess 58 is formed in the longitudinal channel 51 at a position, which is extended from the communication tube 18 coupled with the elevation holes 24 and 16 of the axial and operation pipes 10 in descent of the piston 50. The inner periphery of the longitudinal channel 51 is in close contact with the outer periphery of the axial pipe 20.

The piston 50 is provided with the outer periphery corresponding to the inner periphery of the sleeve tube 60 and a lower portion reduced in diameter. An introduction channel 54 for introducing exhaust is longitudinally formed in an outer portion of the piston 50, and connected to the elevation hole 52. A threshold 56 is formed in a central portion of the introduction channel 54 in tight contact the inner periphery of the sleeve tube 60.

The sleeve tube 60 has an elevation recess 62 in the inner periphery, which serves to receive the threshold 56 of the piston 50 in impact of the hammer bit 70 by the piston 50 to open the exhaust introduction channel 54.

Figure 2:
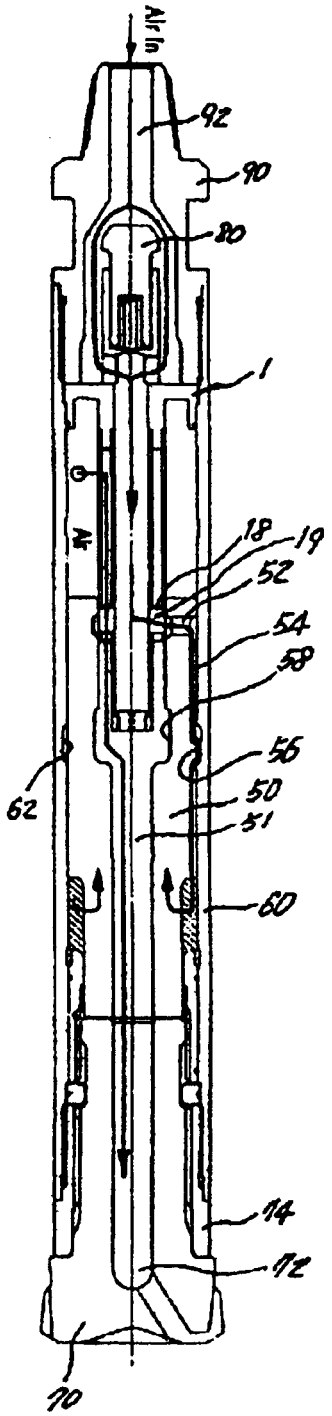
FIG. 2 is a longitudinal sectional view of a bit striking apparatus according to the embodiment of the invention before elevation.

The operation of the invention as set forth above will be described in detail as follows:

When fed through the inlet 92 of the back head 90 as shown in FIG. 2, compressed air is introduced through a space between the back head 90 and the check valve 80, the through hole 42 in the air distributor 1 and the through hole 32 in the fixing wing 30, where compressed air is introduced via the axial hole 22 in the axial pipe 20 into the through holes 19 in the communication tube 18 which is coupled with the elevation holes 24 under the through holes 19.

From the through holes 19 in the communication tube 18, compressed air is introduced via the through holes 19 in the side of the elevation holes 16 in the operation pipe 20 into the elevation hole 52 in the piston 50, where compressed air is introduced via the exhaust introduction channel 54 between the piston 50 and the sleeve tube 60 and the elevation recess 62 in the sleeve tube 60 into a space in the sleeve tube 60 under the piston 50.

As filled in the space in the sleeve tube 60 under the piston 50, compressed air pushes upward the piston 50 within the sleeve tube 60 so that the piston 50 is elevated within the sleeve tube 60.

In the meantime, air in the sleeve tube 60 over the piston 50 is introduced via the descent holes 14 in the operation hole 10 of the air distributor 1 into the introduction hole 12, where air is exhausted via the longitudinal channel 51 of the piston 50 into an exhaust hole 72 of the hammer bit 70.

Figure 3:
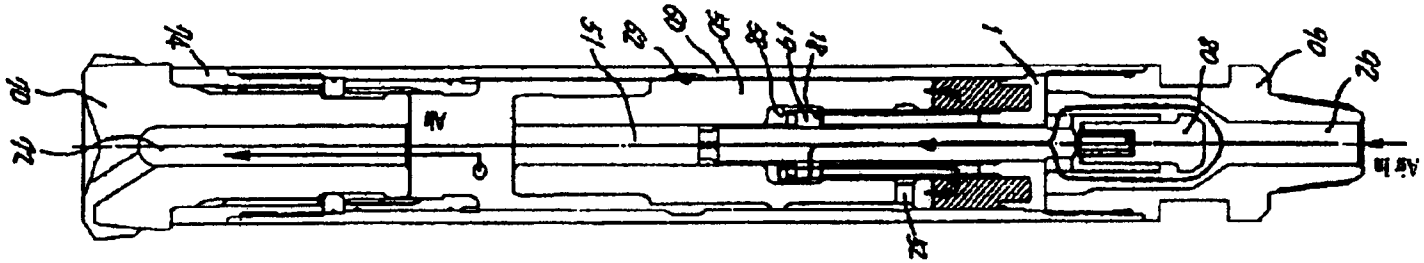
FIG. 3 is a longitudinal sectional view of a bit striking apparatus according to the embodiment of the invention before descent.

With the piston 50 elevated within the sleeve tube 60 as shown in FIG. 3, compressed air which was introduced through the through hole 42 in the air distributor and the through hole 32 is shuttled via the axial hole 22 in the axial pipe 20 into one of the through holes 19 in the communication tube 18 coupled with the elevation holes 24. Then, compressed air is removed from the operation pipe 10 via the other one of the through holes 19 in the communication tube 18 coupled with the elevation holes 16 in the operation pipe 10. Exhausted air is introduced via the return recess 58 of the piston 50 into the introduction hole 12 between the operation pipe 10 and the axial pipe 20 in the lower portion of the axial pipe 20.

After being introduced upward from the lower portion into the introduction hole 12 between the operation pipe 10 and the axial pipe 20, compressed air is filled via the descent holes 14 in the upper portion of the operation pipe 10 into an upper space of the piston 50 between the air distributor 1 and the sleeve tube 60. Filled air descends the piston 50 under a predetermined value of pressure within the sleeve tube 60.

At this time, air existing within the sleeve tube 60 under the piston 50 is removed to the outside via the exhaust hole 72 in the hammer bit 70.

In this manner, the excavator continuously moves the piston 50 up and down through introduction of compressed air into the air distributor 1 as shown in FIGS. 2 and 3 so that the hammer bit 70 under the piston 50 continuously performs excavating operation.

Figure 4:
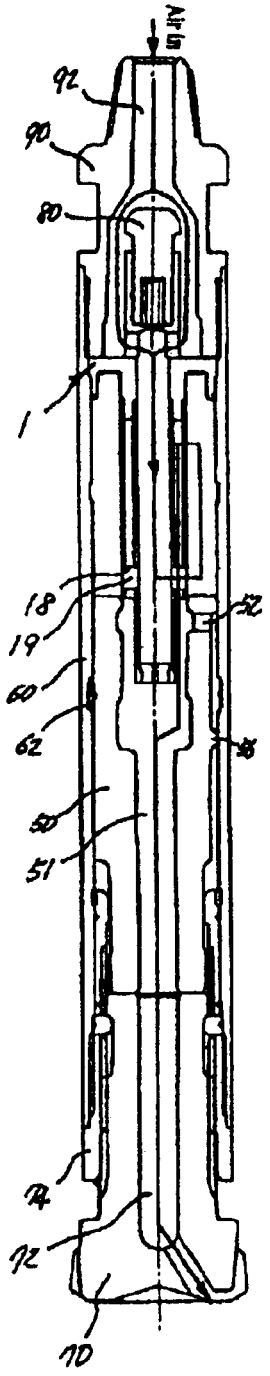
FIG. 4 is a longitudinal sectional view of a bit striking apparatus according to the embodiment of the invention in no-loaded position.
Figure 5:
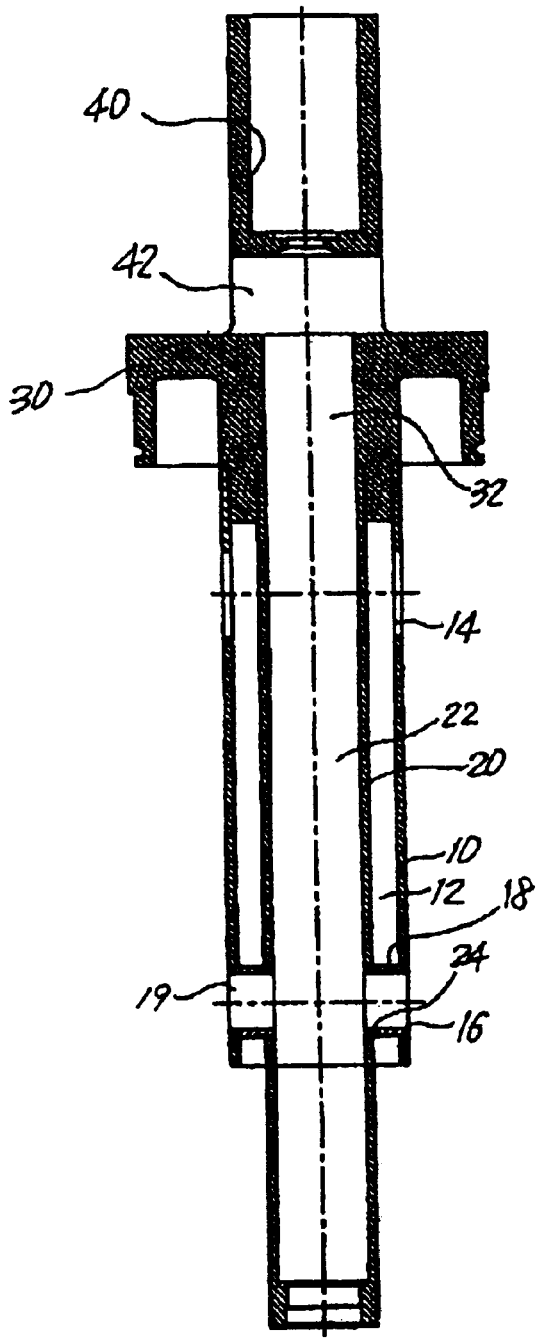
FIG. 5 is an enlarged longitudinal sectional view of an air distributor of the embodiment of the invention.

When an operator raises the excavator more or less as shown in FIG. 4, the hammer bit 70 and the piston 50 descend within the sleeve tube 60, in which compressed air in the air distributor 1 is outwardly removed via the axial hole 22 in the axial pipe 20 and then the through holes 19 in the communication tube 18 connected with the axial and operation pipes 20 and 10. Exhausted air is filled between the air distributor 1 and the sleeve tube 60. Filled air flows downward via the descent holes 14 in the upper portion of the operation pipe 10 and the introduction hole 12 between the operation pipe 10 and the axial pipe 20, into the longitudinal channel 51 opened between the lower portion of the axial pipe 20 and the piston 50, where air is exhausted to the outside via the exhaust hole 72 in the hammer bit 70.

As set forth above, the present invention can efficiently strike the entire area of the hammer bit under uniform pressure without exerting an excessive load to the excavator so that the hammer bit may be free from damage owing to local concentration of striking force of the piston.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

Various references are cited herein, the disclosures of which are incorporated by reference in their entireties.

What is claimed is:

1. A bit striking apparatus in an excavator comprising:

a back head having a central inlet through which air is introduced under a predetermined value of pressure;

a check valve located under the inlet of the back head for preventing backflow of introduced air to the inlet of the back head;

a sleeve tube for being hermetically coupled by an upper inner periphery with a lower end of the back head and slidably coupled by a lower inner periphery with a hammer bit which is fixed by a chuck;

a piston located over the hammer bit within the sleeve tube which is moved up and down within the sleeve tube owing to distribution of air pressure by an air distributor to strike down the hammer bit ; and the air distributor located between the back head and the piston within the sleeve tube for adequately distributing air so that the piston can be vertically moved to strike the hammer bit.

2. The bit striking apparatus of claim 1, wherein the air distributor comprises:

a cylindrical valve recess formed at an upper end for receiving the check valve, a through hole laterally formed under the valve recess, a fixing wing projected toward and tightly fixed to an inner periphery of the sleeve tube under the through holes and having a central through hole, an axial pipe fixed to a lower portion of the fixing wing and having an axial hole and elevation holes laterally formed in a lower portion of the axial pipe, and an operation pipe located under the fixing wing outside the axial pipe, wherein the operation pipe has a central introduction hole, descent holes laterally formed in an upper portion of the operation pipe, elevation holes extended from the elevation holes of the axial pipe, and a communication pipe having through holes and coupled respectively with the elevation holes of said axial pipe.

3. The bit striking apparatus of claim 1, wherein the piston comprises:

a central longitudinal channel for receiving an axial pipe and operation pipe of the air distributor, an elevation hole formed in a position of the piston which is extended from through holes in a communication tube in elevation of the piston within the sleeve tube after striking the hammer bit, a return recess formed in a position in the longitudinal channel which is extended from the through holes in said communication tube in descent of the piston, the longitudinal channel being by its inner periphery in close contact with an outer periphery of said axial pipe under the return recess, the piston having an outer periphery corresponding to the inner periphery of the sleeve, an exhaust introduction channel longitudinally formed at the outer periphery of the piston communicating with said elevation hole, and a threshold formed in a central portion of the introduction channel to tightly contact the inner periphery of the sleeve tube.

4. The bit striking apparatus of claim 3, wherein the sleeve tube includes an elevation recess formed in the inner periphery of said tube.

* * * * *